US005424696A

United States Patent [19]

Nakahara et al.

[11] Patent Number: 5,424,696

[45] Date of Patent: Jun. 13, 1995

[54] SWITCHED LINE PHASE SHIFTER

[75] Inventors: Kazuhiko Nakahara; Naoto Andoh, both of Itami, Japan

[73] Assignee: Mitsubishi Denki Kabushiki Kaisha, Tokyo, Japan

[21] Appl. No.: 53,203

[22] Filed: Apr. 28, 1993

[30] Foreign Application Priority Data

May 8, 1992 [JP] Japan ..... 4-143278

[51] Int. Cl.[6] ..... H01P 1/18; H01P 3/08

[52] U.S. Cl. ..... 333/156; 333/161; 333/164

[58] Field of Search ..... 333/140, 156, 161, 164, 333/139, 138, 104

[56] References Cited

U.S. PATENT DOCUMENTS

| | | | |
|---|---|---|---|
| 5,032,806 | 7/1991 | Nakahara | 333/164 X |
| 5,039,873 | 8/1991 | Sasaki | 333/164 X |
| 5,063,365 | 11/1991 | Cappucci | 333/161 X |
| 5,103,196 | 4/1992 | Nakano et al. | 333/161 |
| 5,116,807 | 5/1992 | Romanofsky et al. | 505/1 |
| 5,126,704 | 6/1992 | Dittmer et al. | 333/125 |
| 5,136,265 | 8/1992 | Pritchett | 333/139 |
| 5,166,648 | 11/1992 | Wen et al. | 333/164 X |

FOREIGN PATENT DOCUMENTS

| | | | |
|---|---|---|---|
| 3265191 | 3/1990 | European Pat. Off. . | |
| 0190701 | 10/1984 | Japan | 333/161 |
| 62-209911 | 9/1987 | Japan . | |
| 63-54012 | 3/1988 | Japan . | |
| 2207805 | 2/1989 | United Kingdom . | |
| 2111757 | 10/1992 | United Kingdom . | |

OTHER PUBLICATIONS

Heston et al, "100 MHz To 20 GHz Monolithic Single-Pole, Two-, Three-, And Four-Throw GaAs Pin Diode Switches", IEEE International Microwave Symposium Digest, Jun. 1991, pp. 429-432.

Coats et al., "A Low Less Monolithic Five-Bit Pin Diode Phase Shifter." 1990 IEEE MTT-S Digest, pp. 915-918.

*Primary Examiner*—Seungsook Ham

*Attorney, Agent, or Firm*—Leydig, Voit & Mayer

[57] ABSTRACT

A switched line phase shifter includes at least three transmission lines having different electrical lengths disposed between an input terminal and an output terminal and connectable in parallel to each other, at least three input side FET switches for connecting and disconnecting the input terminal and the input ends of the transmission lines, and at least three output side FET switches for connecting and disconnecting the output terminal and the output ends of the transmission lines. As many signal transmission paths as transmission lines are produced between the input terminal and the output terminal by controlling the input side and the output side FET switches. When one of the signal transmission paths is selected as a reference and a signal is transmitted through the remaining at least two signal transmission paths, at least two different phase shift quantities are obtained in the phase shifter.

4 Claims, 7 Drawing Sheets

SWITCHED LINE PHASE SHIFTER

FIELD OF THE INVENTION

The present invention relates to a switched line phase shifter providing two or more different phase-shift quantities.

BACKGROUND OF THE INVENTION

FIG. 6 is a circuit diagram illustrating a prior art switched line phase shifter. In FIG. 7, a switched line phase shifter 700 comprises FETs 3*a* to 3*d*, resonant lines 4*a* to 4*d*, and transmission lines 6 and 7. The resonant line 4*a* is connected between a source and a drain of the FET 3*a*, and the source is connected to an input terminal 1. The resonant circuit 4*b* is connected between a source of the FET 3*a* and a drain of the FET 3*b*, and the drain of the FET 3*b* is connected to an output terminal 2. The transmission line 6 is serially connected between the drain of the FET 3*a* and the source of the FET 3*b*. The resonant circuit 4*c* is connected between a source and a drain of the FET 3*c*, and the drain of the FET 3*c* is connected to the input terminal 1. The resonant circuit 4*d* is connected between a source and a drain of the FET 3*d*, and the source of the FET 3*d* is connected to the output terminal 2. The transmission line 7 is serially connected between the source of the FET 3*c* and the drain of the FET 3*d*. Reference numerals 5*a* to 5*d* designate gate bias terminals connected to gates of the FETs 3*a* to 3*d*, respectively. The transmission line 6 serves as a reference line, and the electrical length of the transmission line 7 is longer than the electrical length of the reference transmission line 6 by a prescribed length. Here, the electrical length of a transmission line corresponds to a difference in phases between an input wave and an output wave which are input to and output from the transmission line, respectively.

A description is given of the operation.

In the switched line phase shifter 700, the FETs 3*a* to 3*d* serve as switches operating in accordance with voltages applied to the respective gate bias terminals 5*a* to 5*d*, and two signal transmission paths A and B, extending from the input terminal 1 to the output terminal 2 and having different electrical lengths from each other, are selected by on-off control of the switches 3*a* to 3*d*. A signal input to the input terminal 1 is transmitted through the reference transmission line 6, i.e., the signal transmission path A, or the transmission line 7 the electrical length of which is longer than the electrical length of the transmission line 6, i.e., the signal transmission path B, to reach the output terminal 2. Thus, signals input to the input terminal 1 are output as signals having a difference in phases corresponding to the difference in electrical lengths between the two signal transmission paths 6 and 7, resulting in a prescribed phase-shift quantity. When the signal transmission path A is selected, the FETs 3*a* and 3*b* are turned on while the FETs 3*c* and 3*d* are turned off. When the signal transmission path B is selected, the FETs 3*a* and 3*b* are turned off while the FETs 3*c* and 3D are turned on.

When the gate bias voltage is 0 V, the FETs 3*a* to 3*d* are in the on state, and when the gate bias voltage is lower than a pinch-off voltage, they are in the off state. When the FETs 3*a* to 3*d* are in the on state, a region between source and drain of each FET has a resistance below several ohms, and the FET functions as a low resistance element. When the FETs are in the off state, a region between source and drain of each FET is equivalent to a parallel circuit comprising a resistance of several kilo-ohms and a capacitance (CT), and the capacitance resonates with the resonant line connected between the source and drain of the FET, which means that the FET functions as a capacitor.

However, when a plurality of phase-shift quantities are to be obtained using the conventional switched line phase shifter, a plurality of phase shifters which provide different phase-shift quantities are connected in series according to the number of desired phase-shift quantities as shown in FIG. 7. In FIG. 7, reference numeral 800 designates a multiple bit phase shifter. Numerals 20 to 24 designate switched line phase shifters and numerals 19 designate connecting terminals. Degrees in each block of switched line phase shifter represent phase differences between an input signal and an output signal when the respective phase shifter is used independently. In the conventional multiple bit phase shifter 800, since only one phase-shift quantity is obtained from each of the phase shifters 20 to 24, as many switched line phase shifted as desired phase-shift quantities are required, resulting in an increase in production cost. In addition, the chip size of the multiple bit phase shifter 800 is significantly increased.

SUMMARY OF THE INVENTION

An object of the present invention is to provide a switched line phase shifter that reduces production cost and the chip size of a multiple bit phase shifter comprising a plurality of switched line phase shifters.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to a first aspect of the present invention, a switched line phase shifter includes three or more transmission lines having different electrical lengths from each other which are disposed between an input terminal and an output terminal and connected in parallel to each other, input side FETs serving as switches for connecting input ends of the transmission lines to the input terminal, and output side FETs serving as switches for connecting output ends of the transmission lines to the output terminal. In this structure, as many signal transmission paths as transmission lines are produced. When one of the signal transmission paths is selected as a reference and a signal is transmitted through the remaining two or more signal transmission paths, two or more different phase-shift quantities are obtained in the phase shifter.

According to a second aspect of the present invention, a switched line phase shifter includes three or more transmission lines having different electrical lengths from each other which are disposed between an input terminal and an output terminal and connected in parallel to each other, an input side switching circuit for connecting or disconnecting input ends of the transmission lines with each other or with the input terminal, and an output side switching circuit for connecting or disconnecting output ends of the transmission lines with each other or with the output terminal. In this structure, as many signal transmission paths as transmission lines are produced along the respective transmission lines and, further, more signal transmission paths are produced by appropriately connecting the three or more transmission lines. When one of the signal transmission paths is selected as a reference and a signal is transmitted through remaining signal transmission paths, three or more different phase-shift quantities are obtained in the phase shifter.

According to a third aspect of the present invention, since at least one of the above-described transmission lines is a multilayer interconnection structure, the size of the phase shifter is reduced.

DETAILED DESCRIPTION OF THE PREFERRED EMBODIMENTS

Figure 1:
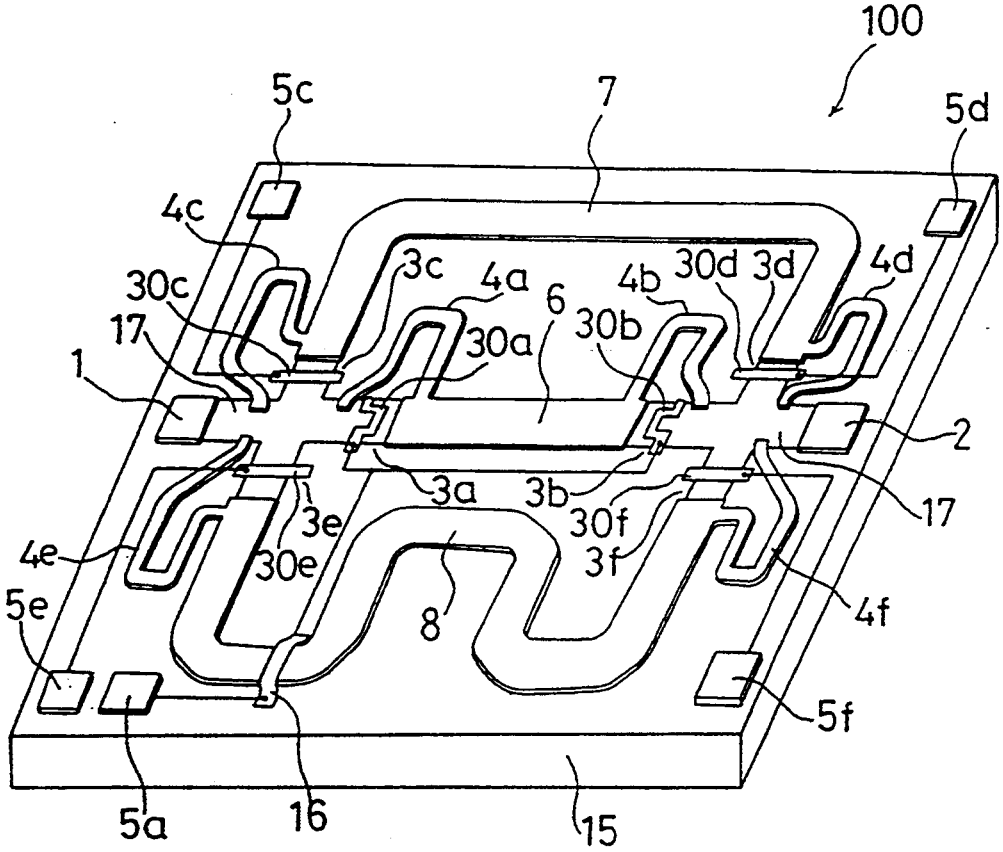
FIG. 1 is a perspective view illustrating a switched line phase shifter in accordance with a first embodiment of the present invention.
Figure 2:
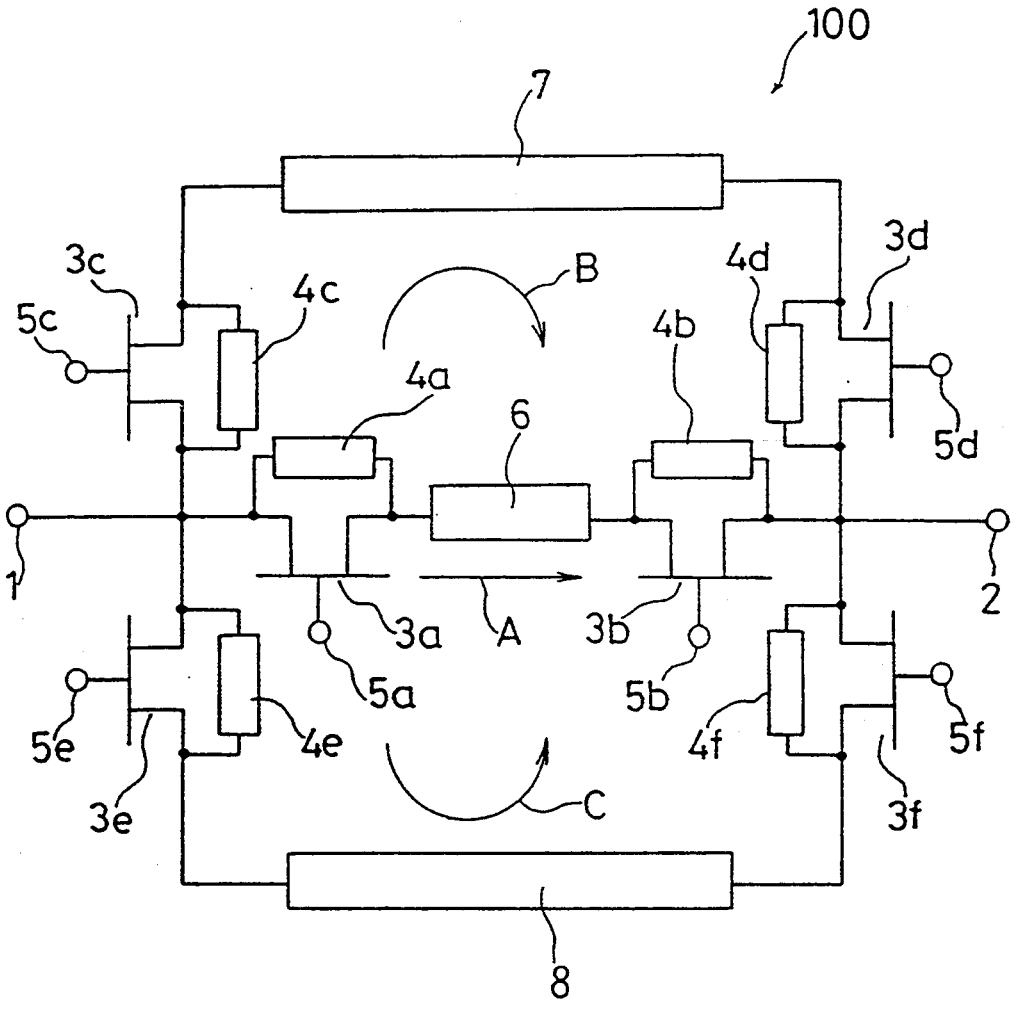
FIG. 2 is an equivalent circuit diagram of the switched line phase shifter of FIG. 1.
Figure 6:
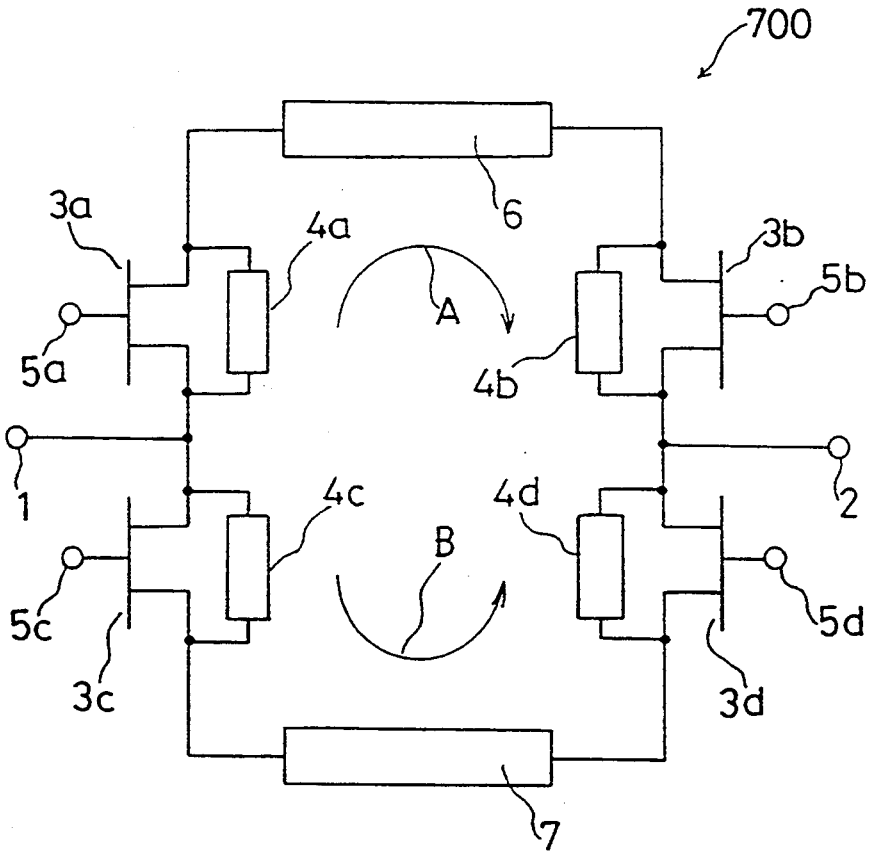
Fig. 6 (Prior Art)
FIG. 6 is a circuit diagram illustrating a switched line phase shifter in accordance with the prior art.
Figure 7:
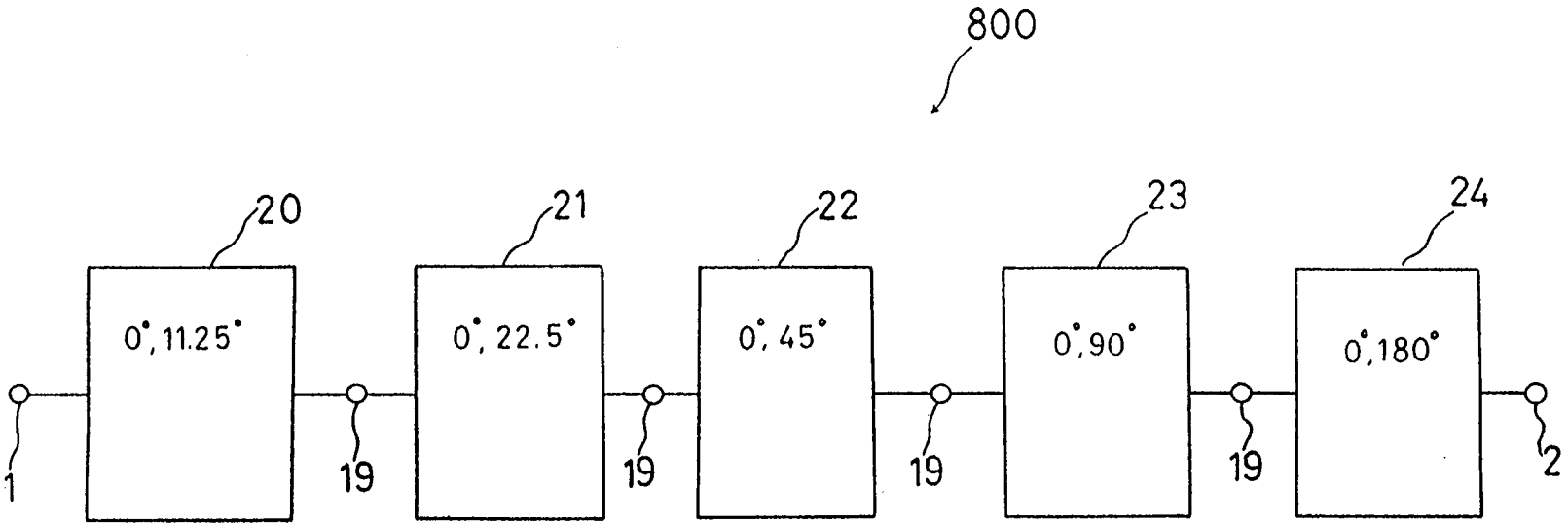
Fig. 7 (Prior Art)
FIG. 7 is a block diagram illustrating a multiple-bit phase shifter comprising a plurality of the switched line phase shifters of FIG. 6.

FIG. 1 is a perspective view illustrating a switched line phase shifter in accordance with a first embodiment of the present invention, and FIG. 2 is an equivalent circuit diagram thereof. In these figures, the same reference numerals as in FIG. 6 designate the same or corresponding parts.

A description is given of the structure of the switched line phase shifter. In FIG. 1, reference numeral 100 designates a switched line phase shifter disposed on a GaAs substrate 15. This switched line phase shifter 100 includes transmission lines 6, 7, and 8 and FETs 3*a* to 3*f*. The transmission lines 6, 7, and 8 have different electrical lengths from each other and are disposed between the input terminal 1 and the output terminal 2 and connected with each other via diffused regions 17. The FETs 3*a*, 3*c*, and 3*e* are disposed between the input terminal 1 and input ends of the transmission lines 6, 7, and 8, respectively, and the FETs 3*b*, 3*d*, and 3*f* are disposed between the output terminal 2 and output ends of the transmission lines 6, 7, and 8, respectively. Resonant lines 4*a* to 4*f* are disposed between sources and drains of the FETs 3*a* to 3*f*, respectively. Gates 30*a* and 30*b* of the FETs 3*a* and 3*b* are connected to a gate bias terminal 5*a*. Gates 30*c* to 30*f* of the FETs 3*c* to 3*f* are connected to gate bias terminals 5*c* to 5*f*, respectively. An air bridge 16 connects the gate bias terminal 5*a* with the gates 30*a* and 30*b* of the FETs 3*a* and 3*b*. The gate bias terminal 5*a* is common to the FETs 3*a* and 3*b* on the GaAs substrate 15.

The description is given of the operation. A fundamental operation of the switched line phase shifter 100 is identical to the operation of the conventional switched line phase shifter 700. While two signal transmission paths A and B are produced in the conventional switched line phase shifter 700, three signal transmission paths A, B, and C are produced in the switched line phase shifter 100 of this embodiment. When two signal transmission paths are selected from the signal transmission paths A, B, and C with the remaining signal transmission path as a reference, two different phase-shift quantities are obtained. The selection is carried out by control of the FETs 3*a*, 3*c*, and 3*e* and the FETs 3*b*, 3*d*, and 3*f* respectively disposed on the input side and the output side of the transmission lines 6, 7, and 8. For example, when a signal input to the input terminal 1 is output from the output terminal 2 through the signal transmission path A, gate bias voltages of the FETs 3*a* and 3*b* are set to 0 V to turn on these FETs while gate bias voltages of the remaining FETs 3*c* to 3*f* are set to a voltage lower than the pinch-off voltage to turn off these FETs, whereby the input signal is transmitted through the signal transmission path A.

According to the switched line phase shifter of this first embodiment, the three transmission lines 6, 7, and 8 having different electrical lengths from each other are disposed between the input terminal 1 and the output terminal 2 and connected to each other via the FETs 3*a* to 3*f*, and the three signal transmission paths A, B, and C having different electrical lengths from each other are produced between the input terminal 1 and the output terminal 2 by control of the FETs 3*a* to 3*f*. Therefore, when two of the signal transmission paths are selected with the remaining transmission path as reference and signals are transmitted through the selected paths, two phase-shift quantities are obtained. That is, the switched line phase shifter 100 of this embodiment serves as a two-bit phase shifter while in the conventional example two switched line phase shifters 700 must be connected in series to achieve a two-bit phase shifter. As a result, a smaller-sized two-bit phase shifter is achieved at lower production cost as compared with the conventional one.

While in the above-described first embodiment three signal transmission lines 6, 7, and 8 having different electrical lengths from each other are connected between the input terminal 1 and the output terminal 2 to attain two different phase-shift quantities, four or more signal transmission lines may be disposed to attain more phase-shift quantities.

Figure 3:
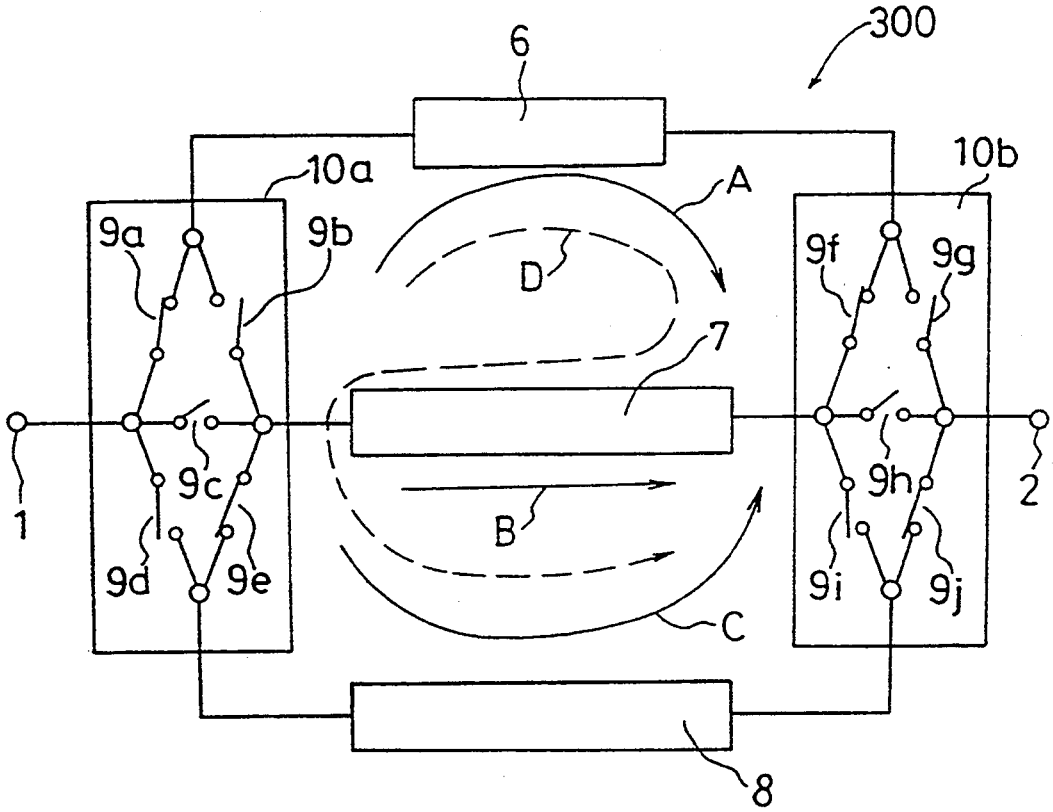
FIG. 3 is a circuit diagram illustrating a switched line phase shifter in accordance with a second embodiment of the present invention.

FIG. 3 is a circuit diagram illustrating a switched line phase shifter 300 in accordance with a second embodiment of the present invention. In FIG. 3, the same reference numerals as in FIGS. 1 and 2 designate the same or corresponding parts. In the switched line phase shifter 300, transmission lines 6, 7, and 8 having different electrical lengths from each other are disposed between the input terminal 1 and the output terminal 2 and connected to each other via switching circuits 10*a* and 10*b*. The switching circuit 10*a* comprises switches 9*a* to 9*e*. The switch 9*a* controls connection between the input terminal 1 and the transmission line 6, the switch 9*b* controls connection between the transmission lines 6 and 7, the switch 9*c* controls connection between the input terminal 1 and the transmission line 7, the switch 9*d* controls connection between the input terminal 1 and the transmission line 8, and the switch 9*e* controls connection between the transmission lines 7 and 8. The switching circuit 10*b* comprises switches 9*f* to 9*j*. The switch 9*f* controls connection between the transmission lines 6 and 7, the switch 9g controls connection between the output terminal 2 and the transmission line 6, the switch 9h controls connection between the output terminal 2 and the transmission line 7, the switch 9i controls connection between the transmission lines 7 and 8, and the switch 9j controls connection between the output terminal 2 and the transmission line 8.

In the switched line phase shifter 300 of this second embodiment, four signal transmission paths A to D with different electrical lengths are produced by on-off control of the switches 9a to 9j. More specifically, the signal transmission path A is produced through the transmission line 6, the signal transmission path B through the transmission line 7, the signal transmission path C through the transmission line 8, and the signal transmission path D through the transmission lines 6, 7, and 8. For example, when the signal transmission path A is a reference path, three different phase-shift quantities are obtained between the reference path A and the signal transmission paths B, C, and D. That is, the switched line phase shifter 300 of this second embodiment serves as a three-bit phase shifter while in the conventional example three phase shifters 700 must be connected to achieve a three-bit phase shifter. As a result, a smaller-sized three-bit phase shifter is achieved at lower production cost as compared with the conventional one.

While in the above-described second embodiment three signal transmission lines 6, 7, and 8 having different electrical lengths from each other are connected between the input terminal 1 and the output terminal 2 via the switching circuits 10a and 10b to attain three different phase-shift quantities, four or more signal transmission lines may be connected via switching circuits to attain more phase-shift quantities.

Figure 4:
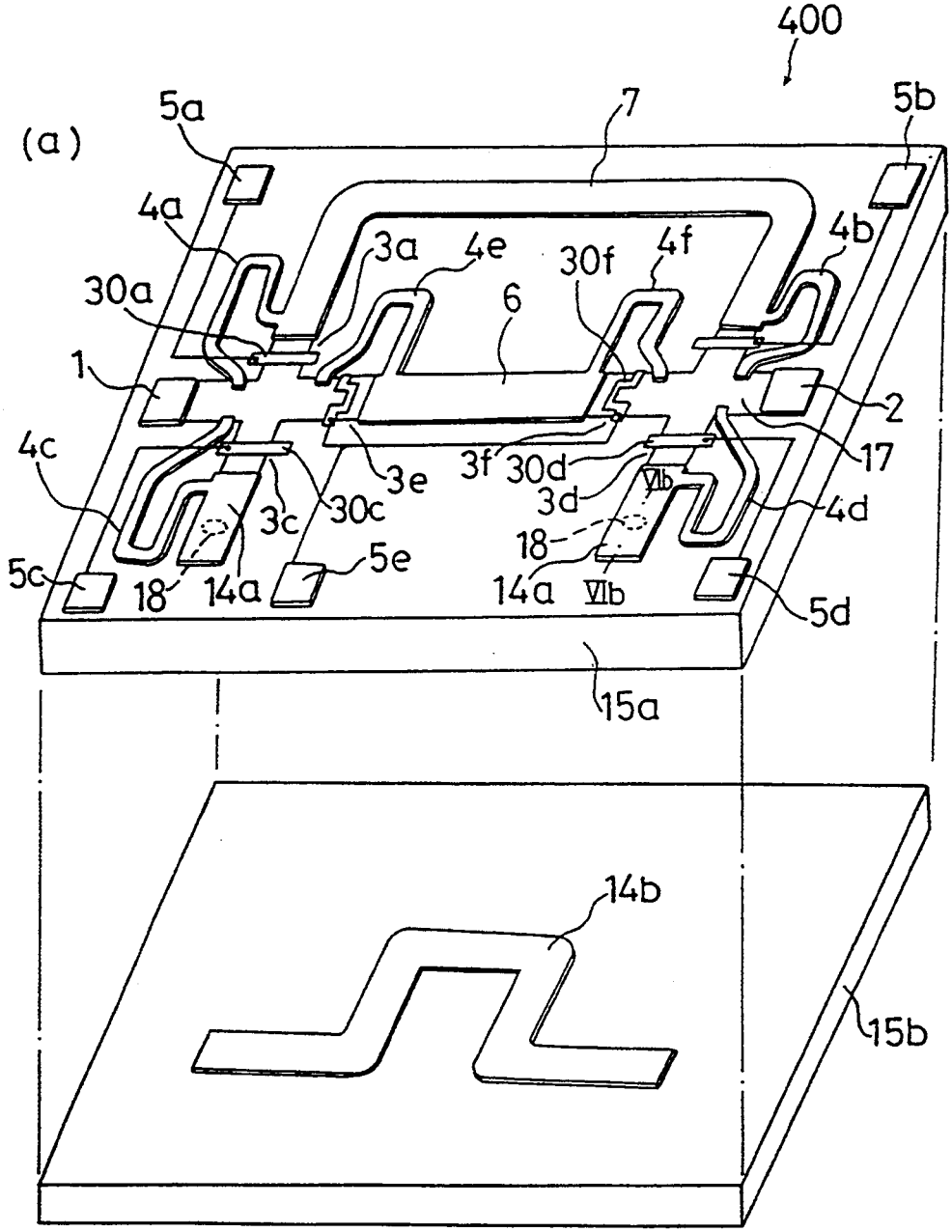
FIGS. 4(*a*) and 4(*b*) are diagrams illustrating a switched line phase shifter in accordance with a third embodiment of the present invention, in which FIG. 4(*a*) is a perspective view thereof and FIG. 4(*b*) is a cross section taken along line IVb—IVb of FIG. 4(*a*)
Figure 4:
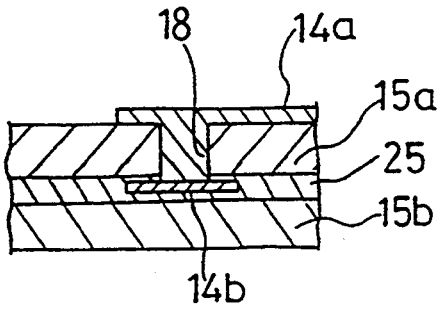
Figure 5:
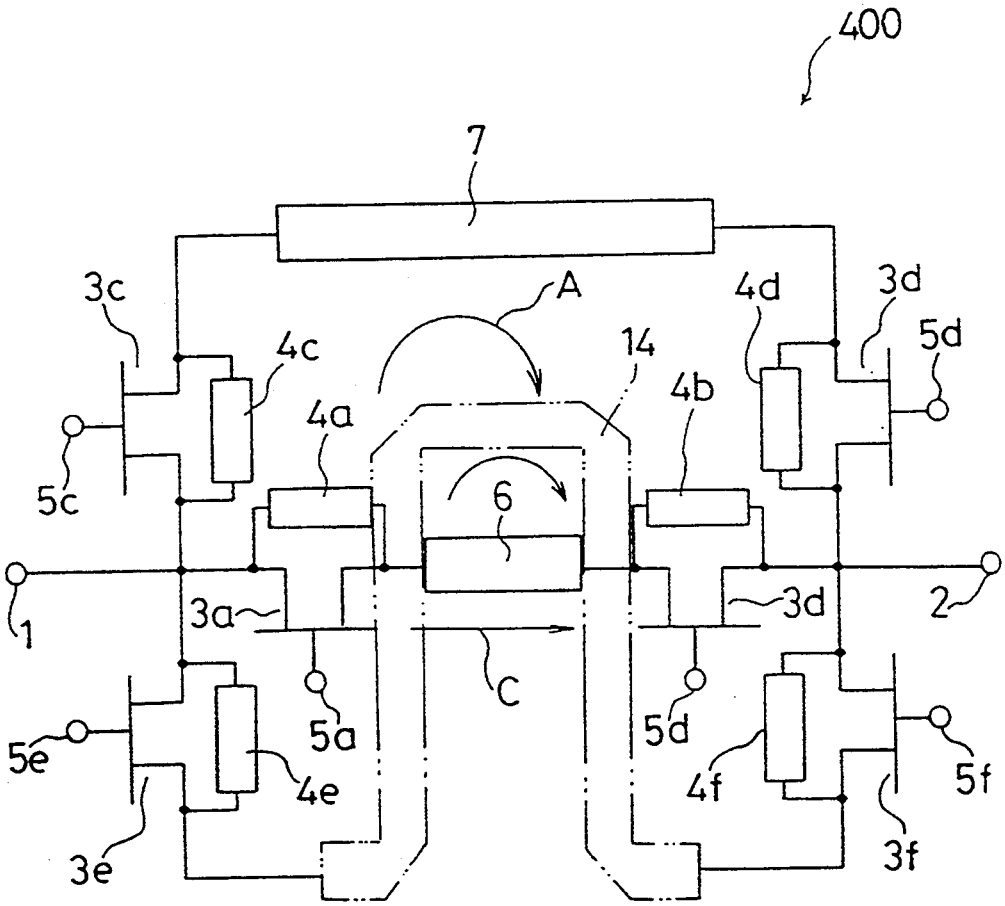
FIG. 5 is an equivalent circuit diagram of the switched line phase shifter of FIG. 4(*a*)

FIG. 4(a) is an exploded perspective view illustrating a switched line phase shifter in accordance with a third embodiment of the present invention. FIG. 5 is an equivalent circuit diagram of FIG. 4(a). In these figures, the same reference numerals as in FIG. 1 designates the same or corresponding parts. In this third embodiment, as shown in FIG. 4(a), a GaAs epitaxially grown layer 15a is disposed on a GaAs substrate 15b on which a transmission line 14b is disposed. Transmission lines 6, 7, and 14a are disposed on the GaAs epitaxially grown layer 15a. The transmission line 14a is connected to the transmission line 14b via contact holes 18. Other parts are the same as those of the switched line phase shifter of FIG. 1.

FIG. 4(b) is a sectional view taken along a line IV(-b)—IV(b) of FIG. 4(a), illustrating a contact part of the transmission lines 14a and 14b. The contact part is produced by a conventional multilayer interconnection technique. More specifically, an inter-layer insulating film 25 and the transmission line 14b are formed on the GaAs substrate 15b, and the GaAs epitaxially grown layer 15a is formed thereon. Then, the contact hole 18 is formed penetrating through the GaAs epitaxial layer 15a and reaching the surface of the transmission line 14b. Then, the contact hole 18 is filled with a metal, i.e., the transmission line 14.

In the switched line phase shifter according to the third embodiment of the present invention, since the transmission line corresponding to the transmission line 8 of FIG. 1 is a multilayer interconnection structure comprising the transmission lines 14a and 14b, the size of the phase shifter 400 is reduced as compared with the phase shifter 100 of FIG. 1.

The transmission line of the switched line phase shifter 300 according the second embodiment of the present invention may include the multilayer interconnection structure with the same effect as described above.

As is evident from the foregoing description, according to the present invention, a switched line phase shifter includes three or more transmission lines having different electrical lengths from each other which are disposed between an input terminal and an output terminal and connected in parallel to each other, input side FETs serving as switches for connecting input ends of the transmission lines to the input terminal, and output side FETs serving as switches for connecting output ends of the transmission lines to the output terminal. Therefore, two or more different phase-shift quantities are obtained in the phase shifter, resulting in a small-sized multiple-bit phase shifter with a low production cost.

According to the present invention, a switched line phase shifter includes three or more transmission lines having different electrical lengths from each other which are disposed between an input terminal and an output terminal and connected in parallel to each other, an input side switching circuit for connecting or disconnecting input ends of the transmission lines with each other or with the input terminal, and an output side switching circuit for connecting or disconnecting output ends of the transmission lines with each other or with the output terminal. Therefore, three or more different phase-shift quantities are obtained in the phase shifter, resulting in a small-sized multiple-bit phase shifter with a low production cost.

What is claimed is:

1. A switched line phase shifter for receiving an input signal and outputting output signals having selectable phase differences relative to said input signal comprising:

an input terminal and an output terminal;

at least three transmission lines having respective input ends, output ends, and different electrical lengths disposed between said input terminal and said output terminal;

an input side switching circuit comprising a first plurality of switches for selectably connecting said input terminal to said input ends of said at least three transmission lines and for selectably connecting said input end of any of said at least three transmission lines to any other of said input ends of said at least three transmission lines independent of any connection of any of said input ends of said at least three transmission lines to said input terminal; and an output side switching circuit comprising a second plurality of switches for selectably connecting said output terminal to said output ends of said at least three transmission lines and for selectably connecting said output end of any of said at least three transmission lines to any other of said output ends of said at least three transmission lines independent of any connection of any of said output ends of said at least three transmission lines to said output terminal, said at least three transmission lines, said input side switching circuit, and said output side switching circuit providing four transmission paths having different electrical lengths between said input terminal and said output terminal selected by controlling said first plurality of switches and said second plurality of switches.

2. The switched line phase shifter of claim 1 wherein said first plurality of switches comprises five input side switches and said second plurality of switches comprises five output side switches.

3. A switched line phase shifter for receiving an input signal and outputting output signals having selectable phase differences relative to said input signal comprising:

a semiconductor substrate and a semiconductor film disposed on said substrate;

an input terminal and an output terminal;

first, second, and third transmission lines having respective input ends, output ends, and different electrical lengths disposed between said input terminal and said output terminal;

an input side switching circuit comprising a first plurality of switches for selectably connecting said input terminal to said input ends of said first, second, and third transmission lines and for selectably connecting said input ends of said first, second, and third transmission lines to each other; and an output side switching circuit comprising a second plurality of switches for selectably connecting said output terminal to said output ends of said first, second, and third transmission lines and for selectably connecting said output ends of said first, second, and third transmission lines to each other, said first, second, and third transmission lines, said input side switching circuit, and said output side switching circuit providing first, second, and third transmission paths having different electrical lengths between said input terminal and said output terminal selected by controlling said first plurality of switches and said second plurality of switches wherein said input terminal, said output terminal, said first and second transmission lines, said input side switching circuit, and said output side switching circuit are disposed on said semiconductor film spaced from an interface of said semiconductor film and said semiconductor substrate, and said third transmission line is disposed on said semiconductor substrate at the interface of said semiconductor substrate and said semiconductor film and includes contact vias penetrating through said semiconductor film and respectively connecting said input end and said output end of said third transmission line to said input side switching circuit and said output side switching circuit.

4. The switched line phase shifter of claim 3 wherein said first plurality of switches comprises three input side field effect transistors and said second plurality of switches comprises three output side field effect transistors.

* * * * *